US008411875B2

(12) United States Patent
Leach et al.

(10) Patent No.: US 8,411,875 B2
(45) Date of Patent: Apr. 2, 2013

(54) SPEAKER CONTROL VIA AUDIO CONNECTION

(75) Inventors: Jonathan W. Leach, Killingworth, CT (US); Andrew G. Berezowski, Wallingford, CT (US); Jesse J. Otis, Hamden, CT (US)

(73) Assignee: Honeywell International Inc., Morristown, NJ (US)

( * ) Notice: Subject to any disclaimer, the term of this patent is extended or adjusted under 35 U.S.C. 154(b) by 1385 days.

(21) Appl. No.: 11/626,971

(22) Filed: Jan. 25, 2007

(65) Prior Publication Data

US 2008/0181436 A1 Jul. 31, 2008

(51) Int. Cl.
*H04R 27/00* (2006.01)
*H04B 3/00* (2006.01)

(52) U.S. Cl. ..... 381/82; 381/77; 381/85

(58) Field of Classification Search ..... 381/77, 381/82, 85, 122, 123
See application file for complete search history.

(56) References Cited

U.S. PATENT DOCUMENTS

| | | | | |
|---|---|---|---|---|
| 7,170,396 | B2 * | 1/2007 | Kalafarski | 340/326 |
| 2002/0163439 | A1 * | 11/2002 | Attimont et al. | 340/825.25 |
| 2004/0106392 | A1 | 6/2004 | Yamasaki et al. | |
| 2005/0032500 | A1 | 2/2005 | Nashif et al. | |

FOREIGN PATENT DOCUMENTS

| | | |
|---|---|---|
| JP | 60-119200 | 6/1985 |
| JP | 2005-159914 | 6/2005 |

OTHER PUBLICATIONS

European Search Report for EP 08250210.5-2225, dated Apr. 14, 2008 (6 pages).

* cited by examiner

*Primary Examiner* — Vivian Chin
*Assistant Examiner* — Douglas Suthers
(74) *Attorney, Agent, or Firm* — Husch Blackwell LLP

(57) ABSTRACT

Members of a plurality of loud speakers receive control commands or signals via audio communication lines. The control commands, or, signals are responded to by those speakers which have been previously addressed.

20 Claims, 2 Drawing Sheets

SPEAKER CONTROL VIA AUDIO CONNECTION

FIELD

The invention pertains to the control of audio output devices. More particularly, the invention pertains to control processes and systems for pluralities of loud speakers in public address systems, or regional monitoring systems.

BACKGROUND

Building control or monitoring systems often include an audio announcement system either integrated or closely associated therewith. Such announcement systems usually locate a number of output transducers, such as loud speakers, throughout a region being monitored. For example, a multiple story building might include a number of loud speakers on every floor of the building for purposes of providing announcements from a common location which might be associated with the building control or building monitoring systems.

Known audio announcement systems can provide both verbal messages which are generated in real-time by either an operator or electronically. Alternately, pre-stored messages can also be forwarded and disseminated via the pluralities of speakers located throughout the region of interest.

In known systems, hundreds of speakers can be connected to the output of a single audio amplifier. Those speakers each play the same message at the same volume. There are times when it would be desirable to be able to control individual speakers so as to, for example, direct messages through specific speakers or to override local volume controls to enable emergency messages to be broadcast at full volume.

It would be preferable if such functionality could be implemented so as to not require modifications to existing audio wiring, for installed systems, which is typically two conductor cables. It would also be desirable to be able to either upgrade or install speaker units which are transparent not only to the existing cabling but also to existing installed loud speakers which building management might want to maintain, at least in part.

DETAILED DESCRIPTION

Figure 1:
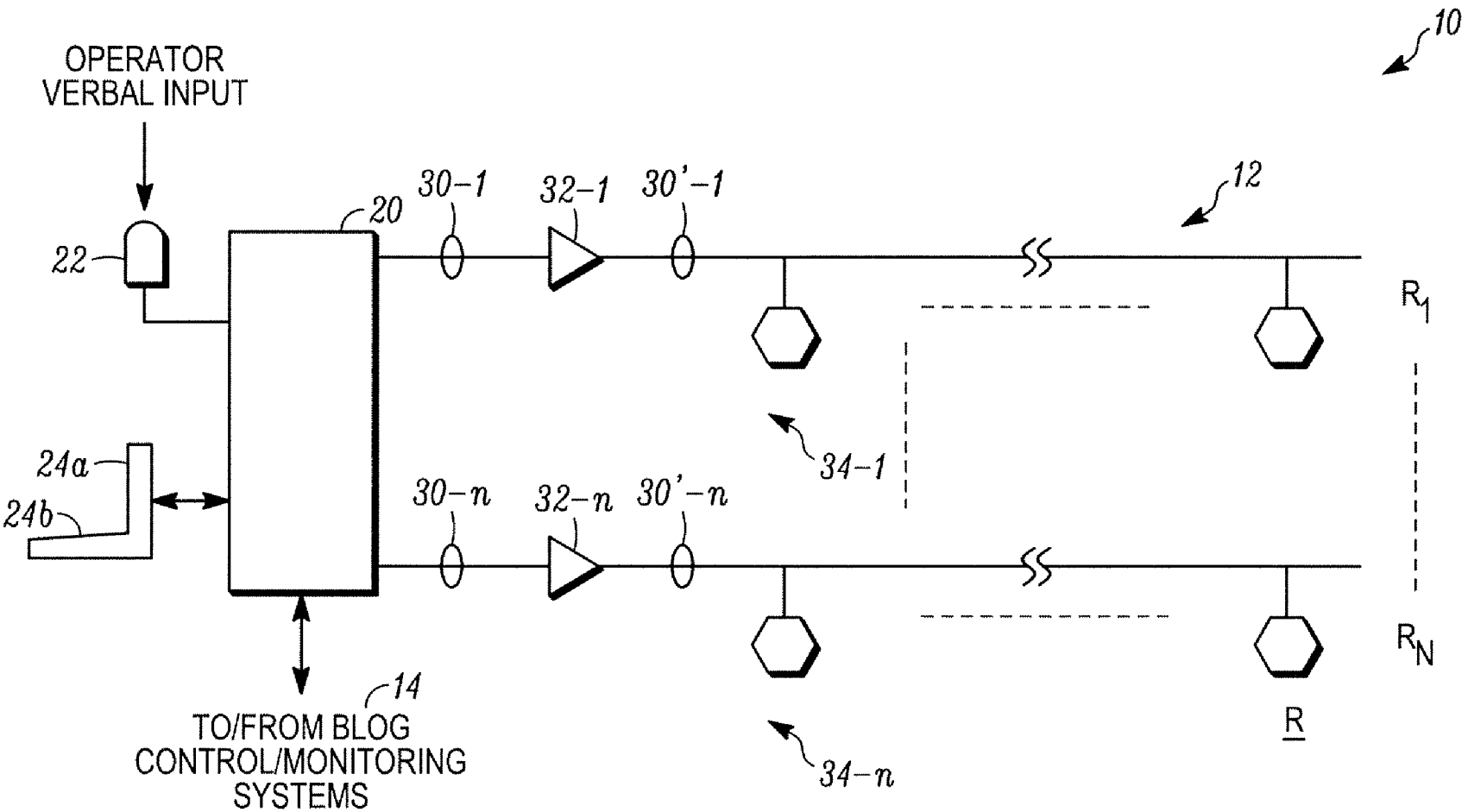
FIG. 1 is an overall block diagram of a system which embodies the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Audio or verbal output modules in accordance with the invention can be energized using existing audio wiring. Such modules could, in one embodiment, include one or more relays or switches, as well as a programmable processor, a power source and a communications interface, all of which receive signals in one form or another via the audio wiring.

In one aspect of the invention, the communications interface can provide a path for control signals or commands transmitted by an amplifier to the module. Such control signals or commands could be transmitted at frequencies which are outside of normal human audio range. Such signals or commands could cause the module to assume a plurality of different states. Additionally, such signals could include individual or group addresses identifying a particular audio output module or a group thereof to which the control signals or commands are directed.

Embodiments of the invention include a plurality of devices or modules each with an input connected to audio wiring (two or more conductors) and an output connected to a speaker or speakers. The devices or modules can be, without limitation, part of a regional public address-type system, or, part of a regional monitoring system.

The individual modules are addressable electromechanically or via software programming. Each device may receive power from the audio wiring input or via an additional power input. Each device contains a communication interface and control circuitry, such as a microprocessor, to interpret signals on the audio wiring input as control commands for the module at a specific address. Each device can connect or disconnect the speaker(s) from the input audio wiring by interpreting signals on the input audio wiring and making or breaking the signal path to the speaker(s) by means of a switching device, such as a relay or transistor.

Initially, speakers are disconnected from the speaker wiring and the audio input circuitry is in the "normal audio mode". A change in the polarity or level of a DC signal, the presence of a particular AC signal or some combination of signals on the audio wiring could indicate to the communication interface of the invention that the controlling device, such as an amplifier, was sending control signals (control mode). The control signals could consist of pulses of AC signals, such as Dual Tone Multi Frequency (DTMF) signals or frequency shift keyed (FSK) signals for example, pulses of DC signals or some combination thereof.

Devices differentiate between multiple signals presented via the audio wiring based on the address assigned to each device and so each device acts on the commands specifically intended for it. Multiple devices may be assigned the same address. Devices may also act on general commands issued to all devices (independent of addressing) connected to the audio input wiring or to sub-commands issued to subsets of devices based upon addresses assigned to individual modules within multiple address ranges.

To avoid audible affects at the speakers, once a command is received, the device may delay action or specifically wait for signals indicating that the audio input wiring has returned to the "normal audio mode" before performing its indicated command, such as connecting speaker(s) to audio or bypassing local volume control. To control the speaker(s) again, the controlling device might again enter the "control mode", and the invention might disconnect the speaker(s) from the audio circuit again to avoid audible affects at connected output speakers before discriminating and acting on subsequent commands as described above.

FIG. 1 illustrates an overall diagram of a system 10 which embodies the invention. System 10 includes an audio announcement system 12 which has been installed in a building or region R of interest. The system 12 can also be in communication with building control and/or monitoring systems 14 of a type known to those of skill in the art. Such systems could include HVAC systems, as well as systems for monitoring for the presence of fire, gas or other alarm conditions.

Audio announcement system 12 includes a control unit 20 which could be implemented with one or more programmed processors as would be understood by those of skill in the art.

System 20 also includes an audio input transducer, such as a microphone 22 usable by an operator to couple real-time verbal messages to various subregions R1 . . . Rn of the region R all without limitation.

System 20 could also include a computer driven display unit 24*a* as well as one or more input devices 24*b* which could include keyboards, track balls and the like all without limitation. Control unit 20 can communicate with the operator via display 24 and a graphical user's interface which can provide status information and identify, for example a selected subregion or regions of interest.

Control unit 20 generates output audio signals on a plurality of cables such as 30-1 . . . 30-*n* which are coupled via a respective output amplifier such as 32-1 . . . 32-*n* and cables 30'-1 . . . -*n* to respective audio or verbal output modules, members of pluralities 34-1 . . . 34-*n*.

Those of skill in the art will understand that while it is desirable to be able to use a common set of audio output cables such as 30-*i*, 30'-*i* for a plurality of audio output devices such as 34-*i* in a respective region Ri that it would also be desirable to be able to control individual modules and each of their respective pluralities 34-*i* depending on the exigencies at hand. It would also be preferable to be able to issue commands from the control unit 20 to one or more modules of the pluralities 34-*i*.

Figure 2:
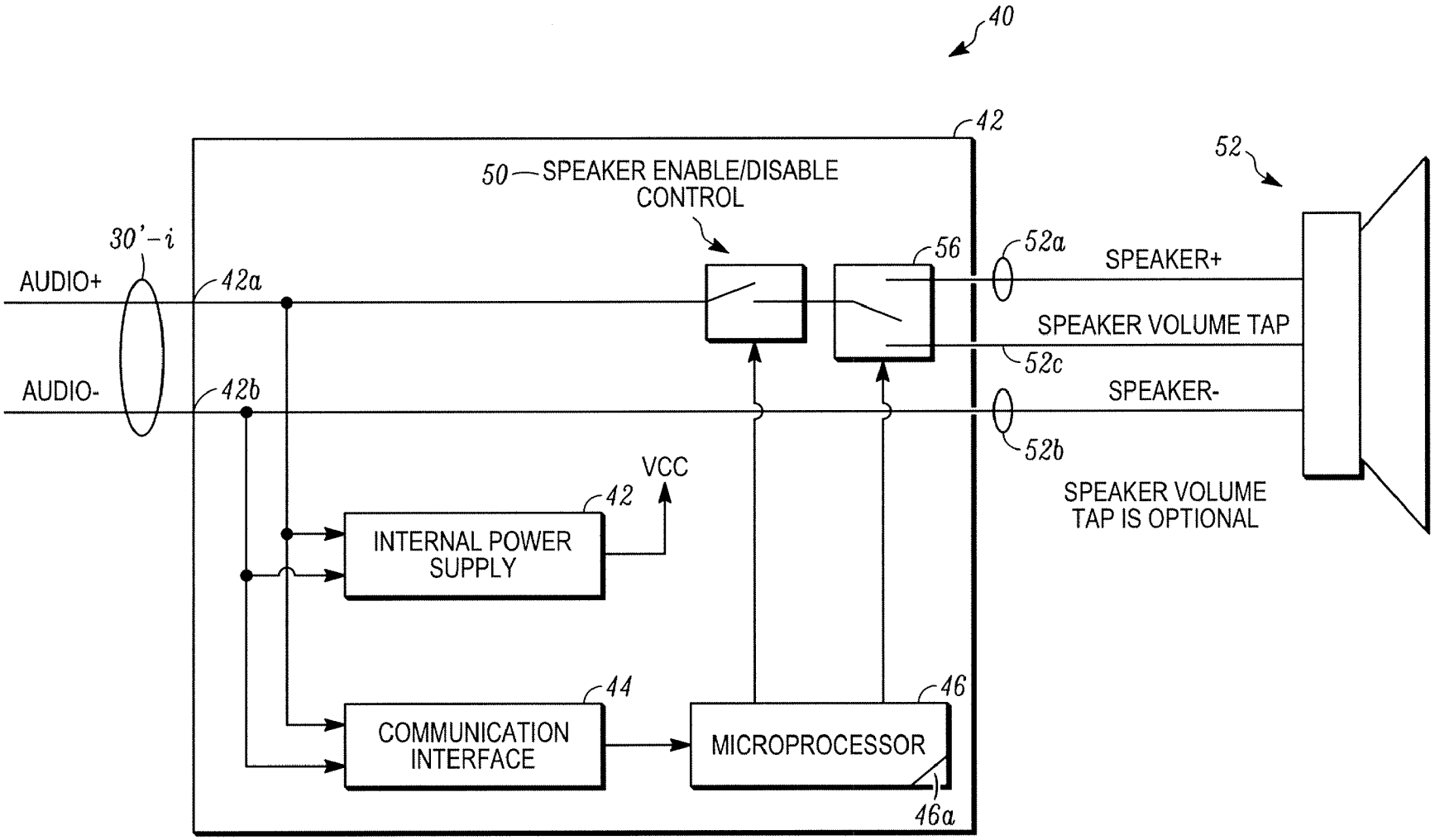
FIG. 2 is a block diagram of a verbal output module which embodies the invention.

FIG. 2 illustrates details of an audio or verbal output module 40 which corresponds to members of the pluralities 34-1 . . . 34-*n*. Exemplary module 40 is contained in a housing 42 which carries a plurality of audio input ports 42*a, b*. The ports 42*a, b* can be coupled to a representative one of the cables 30'-*i* which receives signals from the control system 20.

Module 40 includes a power supply 42 which can receive electrical energy via the signals on the cables 30'-*i*, a communication interface 44 which is in turn coupled to a programmable processor 46. Processor 46 is in turn coupled to one or more storage units 46*a* which provide a medium for storage of respective control programs. The units 46*a* might be implemented as read only memory units or electrically erasable, programmable read only memory or the like all without limitation.

Module 40 also includes at least one control switch 50 which can, in response to commands from processor 46, couple audio signals on the lines 30'-*i* to an output transducer or loud speaker 52. Preferably the output transducer 52 will be able to project verbal messages, whether generated by an operator in real-time or recorded or synthetically generated, into a respective region Ri.

The transducer 52 includes at least first and second audio inputs 52*a, b* coupled to respective output ports on the housing 50 for receipt of audio on the cables 30'-*i*. Audio can be coupled to the transducer 52 or interrupted by the processor 46 using the control switch or control element 50. Additionally, processor 46 can adjust a volume output parameter via a control switch or control element 56 which can be coupled to a speaker or transducer input volume tap 52*c*.

The signals carried by the audio input cables such as 30'-*i* and received by the module 40 can include individual module addresses, group addresses, and commands for the individual or addressed group members to carry out. In this regard, output audio to the transducer 52 can be disabled by the processor 46 responding to received commands using control element 50. Additionally, a volume output parameter can be adjusted via processor 46 in response to received commands.

Those of skill in the art will understand that the exact format of the commands being coupled via the audio cables 30'-*i* to the modules, such as module 40 are not limitations of the present invention. Such commands can be transmitted via the lines 30'-*i* as pulses of various formats such as AC or DC pulses, dual tone multi-frequency (DTMF) signals, frequency shift key (FSK) signals or the like or combinations thereof, all without limitation. Such command signals may be at, but are not limited to frequencies beyond the response range of the transducer 52, or the response range of humans in the respective region Ri. The modules may also be capable of recognizing certain spoken words, phrases or phonemes. In addition to such commands, verbal messages or other types of audio signals can be transmitted from control unit 20 to the respective module(s), such as the module 40 for broadcasting into a region in the vicinity of the respective module for purposes of providing information, instructions or alerts to individuals adjacent thereto.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A speaker module comprising:

a pair of audio input ports that together form a common circuit path and that together receive audio signals and control signals commonly carried by the pair of audio input ports;

a loud speaker;

control circuitry, coupled to at least one of the ports, and the speaker; and a programmed processor coupled to the pair of input ports and control circuitry, the programmed processor is responsive to the control signals received through the pair of audio input ports and operates to switch the control circuitry between a speaker output mode and a different mode wherein the speaker output mode broadcasts the audio signals as verbal messages or other types of audio signals into a region in the vicinity of the speaker module and wherein the control signals received on the pair of audio input ports are beyond the response range of the loudspeaker.

2. A module as in claim 1 which includes a settable address defining element.

3. A module as in claim 2 where the element comprises one of an electromechanical member or an electronic address specifying circuit.

4. A module as in claim 2 where the control circuitry includes the programmable processor and executable software.

5. A module as in claim 4 which includes additional circuitry wherein the executable software is stored.

6. A module as in claim 4 where the software, when executed, determines if an address received at an input port matches an address preset at the element.

7. A module as in claim 6 where the software, responsive to an address match, evaluates a received command in the control signals.

8. A module as in claim 7 where the control signals comprise a plurality of commands evaluatable by the software.

9. A module as in claim 8 where the plurality of commands includes at least some of, output audio, or, terminate audio output.

10. A verbal output module comprising:

a pair of input ports for signals which together form a common circuit path and which together carry a verbal message and control signals where the verbal message and control signals are commonly carried by the pair of input ports;

a verbal output transducer;

an electrical switch coupled between at least one of the ports and the transducer, the switch having at least two states; and a programmable processor coupled to the pair of input ports and to a control port of the switch and software executable by the processor to change the state of the switch in response to a command of the control signals received via the input ports wherein during a first of the at least two states the verbal output transducer broadcasts the verbal message into a region in the vicinity of the module and wherein the control signals on the pair of audio input ports are beyond the response range of the verbal output transducer.

11. A module as in claim 10 which includes interface circuitry coupled between the input ports and the processor.

12. A module as in claim 10 which includes a power supply with an energy input port coupled to the input ports.

13. A module as in claim 11 which includes a power supply with an energy input port coupled to the input ports.

14. A module as in claim 10 where the software responds to a plurality of different commands received via the input ports.

15. A module as in claim 14 where the commands include coupling verbal messages from the input ports to the transducer, and altering a volume output parameter of the transducer.

16. A module as in claim 13 where the software responds to received commands which include coupling verbal messages from the input ports to the transducer, and altering a volume output parameter of the transducer.

17. A module as in claim 10 where the software responds to module specifying indicia received via the ports.

18. A system comprising a plurality of audio output modules coupled by a medium to a source of audio signals, each of the modules comprising:

a pair of input ports for signals which together faun a common circuit path and which together carry a verbal message and control signals where the verbal message and control signals are commonly carried by the pair of input ports;

a verbal output transducer;

an electrical switch coupled between at least one of the ports and the transducer, the switch having at least two states;

control circuitry coupled to the pair of input ports and to a control port of the switch and software executable thereby to change the state of the switch in response to a command received via the pair of ports, where the software responds to module specifying indicia of the control signals received via the pair of ports; and where the software responds to received commands of the control signals which include at least, a command to couple verbal messages from the pair of input ports to the transducer, and a command of the control signals to alter a volume output parameter of the transducer wherein during a first of the at least two states the verbal output transducer broadcasts the verbal messages into a region in the vicinity of the module and wherein the control signals on the pair of audio input ports are beyond the response range of the verbal output transducer.

19. A system as in claim 18 where at least some of the modules include a local power supply which is coupled to the input ports for receipt of electrical energy.

20. A system as in claim 19 where the control circuitry includes a second switch coupled to the output transducer, altering a state of the second switch, in response to a received volume control command, alters output volume of the transducer.

* * * * *